United States Patent [19]

Vail et al.

[11] 4,125,908

[45] Nov. 21, 1978

[54] INVALID TRANSFER LIFT

[76] Inventors: Dottie J. Vail; Nancy Getches, both of 4608 S. Wood St., Chicago, Ill. 60609

[21] Appl. No.: 798,158

[22] Filed: May 18, 1977

[51] Int. Cl.[2] ..... A61G 7/10

[52] U.S. Cl. ..... 5/86; 104/94; 105/29; 105/155; 212/11; 212/18; 214/DIG. 13

[58] Field of Search ..... 5/83, 84, 85, 86, 87, 5/88, 89; 214/DIG. 13; 104/94; 105/153, 155, 29 R; 212/11, 18

[56] References Cited

U.S. PATENT DOCUMENTS

| | | | |
|---|---|---|---|
| 662,477 | 11/1900 | Ulrich | 5/89 |
| 1,536,766 | 5/1925 | Cammann | 5/85 |
| 1,564,895 | 12/1925 | Rengert | 212/11 |
| 2,272,778 | 2/1942 | Reuter | 5/85 |
| 2,368,390 | 1/1945 | Winter | 5/86 |
| 3,351,959 | 11/1967 | Turan | 5/83 |
| 3,854,406 | 12/1974 | Monne | 105/153 |

*Primary Examiner*—Mervin Stein
*Assistant Examiner*—Alex Grosz
*Attorney, Agent, or Firm*—Hosier, Niro & Daleiden, Ltd.

[57] ABSTRACT

An apparatus for lifting and transporting an invalid from a wheelchair to a bed or other location and back including a sling suspended from a motor driven winch for raising and lowering the sling. The winch is suspended from a motorized traverse mechanism for reciprocably moving the winch and sling along a horizontal track attached to the ceiling of a room for transporting the invalid.

5 Claims, 3 Drawing Figures

INVALID TRANSFER LIFT

BACKGROUND OF THE INVENTION

This invention relates to an apparatus for lifting and transporting an invalid, and more particularly, a hoist and conveyor operable by the invalid for transferring the invalid from a bed to a wheelchair or from a wheelchair to a bath and back.

The hoist and conveyor of the present invention is especially useful for invalids having full use of their motor facilities from the waist up, who through use of the apparatus may easily lift and transport themselves from one room to another without assistance of a nurse or other attendant.

SUMMARY OF THE INVENTION

In accordance with the invention, a track is embedded in the ceiling or mounted on the ceiling and extends from room to room. Suspended from the track is a sling for suporting the invalid. A motorized winch is provided between the sling and track for raising and lowering the sling and lifting and lowering the invalid. A reversible traverse motor above the winch rotatably operates a pair of wheels on the track through a pinion and rack to move the sling back and forth along the track to transport the invalid from room to room. The winch and traverse motor are both operated from a control box suspended on the sling.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 1:
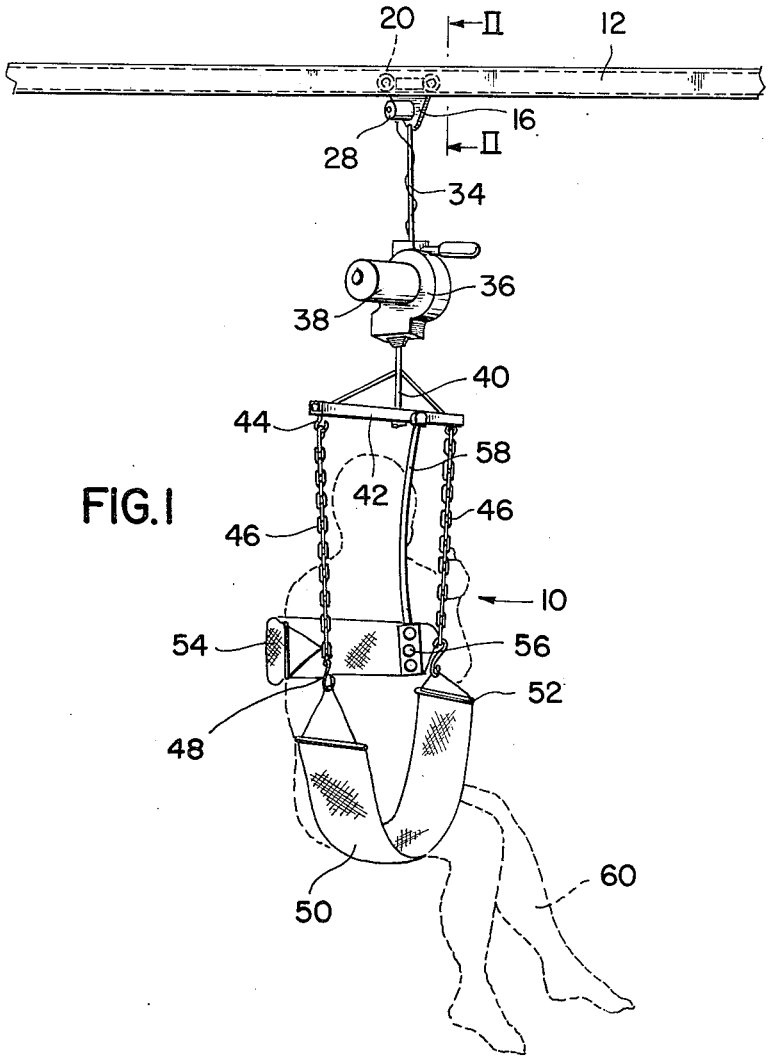
FIG. 1 is a perspective view of the invalid transfer and lifting apparatus of the present invention.
Figure 2:
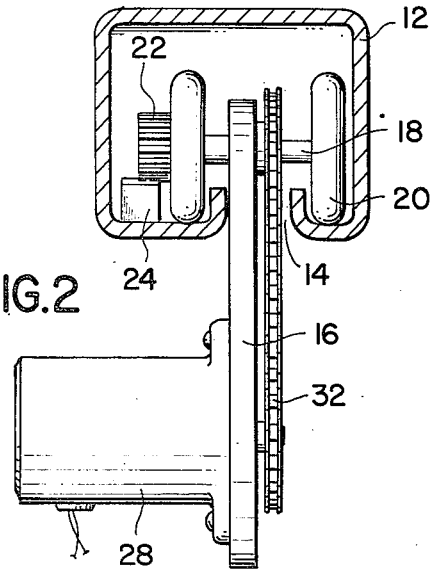
FIG. 2 is a cross-sectional view taken substantially along the plane indicated by line 11—11 of FIG. 1.
Figure 3:
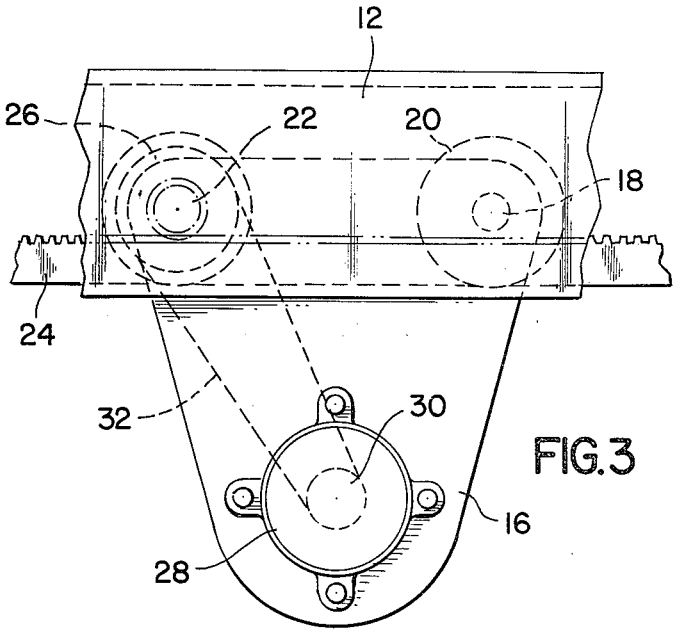
FIG. 3 is a side view in elevation of that portion of the apparatus illustrated in FIG. 2.

Referring now to the drawing in detail, wherein like numerals indicate like elements throughout the several views, the invalid transfer lift 10 of the present invention includes a substantially rectangular track 12 attached to the ceiling of a room, having a slot 14 along its bottom surface receiving a substantially triangular plate 16.

Rotatably mounted on the upper corners of plate 16 is an axle or shaft 18 having a wheel 20 on each end in rolling engagement with the interior bottom surface of track 12 straddling opening 14. A pinion 22 is fixed to an end of one of the shafts 18 and is placed in meshing engagement with a horizontal rack 24 on the bottom surface of track 12. A sprocket 26 is fixed to a shaft 18 mounting the pinion 22 intermediate the ends of the shaft. A reversible electric motor 28 is mounted on the apex of plate 16 and has a sprocket 30 connected to its output shaft drivingly connected to an endless chain 32 entrained about sprockets 30 and 26. Rotation of chain 32 by motor 28 will rotate a shaft 18 and pinion 22 to move plate 16 along rack 24 and track 12 in a direction depending upon the direction of rotation of motor 28.

Suspended from plate 16 is a cable 34 mounting a power winch 36 driven by an electric motor 38. The cord or cable 40 wound on winch 36 has one end connected to a horizontal bar 42 provided with a pair of hooks 44 at each end. Each hook 44 engages a link of a chain 46 having a hook 48 on its opposite end supporting a canvas seat 50 of a sling 52. A canvas back support 54 is mounted between chains 46 above seat 50.

An electrical control box 56 adapted to be connected to a suitable source of electrical energy is hung from bar 42 by a flexible cable 58. Cable 58 includes wires connecting the energy source to motors 38 and 28.

In use, an invalid 60 can hoist himself on seat 50 of sling 52, and activate a switch on box 56 to operate motor 38 to raise and lower the sling 50. Another switch on box 56 is used to operate motor 28 to move the entire suspended apparatus 10 reciprocably along track 12 to a desired location and destination.

While a specific embodiment of an invalid transfer lift has been disclosed in the foregoing description, it will be understood that various modifications within the spirit of the invention may occur to those skilled in the art. Therefore, it is intended that no limitations be placed on the invention except as defined by the scope of the appended claims.

I claim:

1. A remote controlled motorized invalid transfer lift capable of simultaneous vertical and transverse movement comprising:

a suspended sling including a seat and back support, and a pair of oppositely disposed chains secured at one end to said seat and at their opposite ends to a horizontal bar disposed above said sling;

motorized winch means secured to said horizontal bar and mounting said sling for vertical reciprocating movement;

a horizontally disposed generally rectangular track adapted to be mounted on the ceiling of a room, and including a rack enclosed within and extending along the length of said track and an associated pinion enclosed within and in meshing engagement with said rack;

motorized traverse means disposed between said track and winch means for supporting and reciprocally moving said winch means and sling transversely along said track, said traverse means including (a) an axle enclosed within said track and carrying respectively a pair of oppositely disposed wheels aligned in rolling engagement with said track, a sprocket for imparting rotational movement to said axle, and said pinion for translating rotational movement of said axle into transverse movement of said sling, (b) a plate interconnecting said axle and said winch means, and (c) a reversible electric motor mounted on said plate and drivingly connected to said axle for moving said wheels along said track, said track having an elongated slot extending along its bottom surface for receiving said plate; and control means electrically connected to said motorized winch means and traverse means for controlling vertical and transverse movement of said sling from a single remote location.

2. The motorized invalid transfer lift of claim 1 wherein said track is capable of being secured in a continuous pattern in one or more rooms.

3. The motorized invalid transfer lift of claim 1 wherein said reversible electric motor is electrically connected to said control means, and is drivingly connected to said axle by an endless chain associated with the sprocket carried by said axle.

4. The motorized invalid transfer lift of claim 3 wherein said winch means is driven by an electric motor and is connected to said plate by a suspended cable.

5. The motorized invalid transfer lift of claim 4 wherein said control means is mounted on said sling and contains electrical means associated with said winch and transverse means for independently controlling the vertical and transverse movement of said sling.

* * * * *